US008215275B2

(12) United States Patent
Church

(10) Patent No.: US 8,215,275 B2
(45) Date of Patent: Jul. 10, 2012

(54) SINGLE LOBE DEACTIVATING ROCKER ARM

(75) Inventor: Kynan L. Church, Corbett, OR (US)

(73) Assignee: Eaton Corporation, Cleveland, OH (US)

( * ) Notice: Subject to any disclaimer, the term of this patent is extended or adjusted under 35 U.S.C. 154(b) by 146 days.

(21) Appl. No.: 12/856,266

(22) Filed: Aug. 13, 2010

(65) Prior Publication Data

US 2012/0037107 A1 Feb. 16, 2012

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.39, 123/90.16, 90.44; 74/559, 567, 569
See application file for complete search history.

(56) References Cited

U.S. PATENT DOCUMENTS 4,151,817 A 5/1979 Mueller
4,203,397 A 5/1980 Soeters, Jr.
4,762,096 A 8/1988 Kamm et al.
4,768,467 A 9/1988 Yamada et al.
5,419,290 A 5/1995 Hurr et al.
5,445,116 A 8/1995 Hara
5,529,033 A 6/1996 Hampton
6,325,030 B1 12/2001 Spath et al.
6,532,920 B1 3/2003 Sweetnam et al.
6,997,152 B2 2/2006 Harris
7,546,822 B2 6/2009 Murphy et al.
7,730,861 B2 * 6/2010 Ng ..... 123/90.39
2008/0245330 A1 10/2008 Deierlein

* cited by examiner

*Primary Examiner* — Ching Chang
(74) *Attorney, Agent, or Firm* — Benesch, Friedlander, Coplan & Aronoff, LLP

(57) ABSTRACT

A deactivating rocker arm for use with a cam having at least one no-lift safety lobe is provided. Safety lobe contacting surfaces on the rocker arm are configured for contact with safety lobes during abnormal operation of the rocker arm. When the rocker arm is deactivated, the safety lobe contacting surfaces may come into contact with safety lobes when excessive pump-up of a lash adjuster brings the rocker arm undesirably close to the rotating cam. This contact limits the range of motion of the rocker arm during certain instances of abnormal operation, promoting more effective transition between deactivated and activated states and preventing damaging contact between the rocker arm and the cam lobe.

19 Claims, 3 Drawing Sheets

SINGLE LOBE DEACTIVATING ROCKER ARM

FIELD OF THE INVENTION

This application is directed to deactivating rocker arms for internal combustion engines.

BACKGROUND

Many internal combustion engines utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. In order to return to an activated state from a deactivated state, the mechanism may require that the rocker arm be in a particular position or within a range of positions that may not be readily achieved while undergoing certain unconstrained movement while in the deactivated state, such as during excessive lash adjuster pump-up.

SUMMARY

In one embodiment, a rocker arm for engaging a cam having at least one lift lobe and at least one substantially circular safety lobe is provided. The lift lobes that the rocker arm is configured to be capable of engaging have a lift lobe base circle, each having a base circle diameter, while the circular safety lobes are positioned concentrically with the base circle of the lift lobe and have a diameter less than the diameter of the base circle. The rocker arm has an outer arm, an inner arm, a pivot axle, a lift lobe contacting bearing, a bearing axle, and a bearing axle spring. The outer arm and inner arm have first and second side arms. The first and second outer side arms have at least one safety lobe contacting surface among them configured to be spaced from the safety lobes during normal engine operation. The first and second outer side arms also have outer pivot axle apertures configured to accept the pivot axle. The inner arm is disposed between the first and second outer side arms. The first and second inner side arms also have inner pivot axle apertures configured to accept the pivot axle. The first and second inner side arms have inner bearing axle apertures configured to accept the bearing axle. The pivot axle is mounted within the inner pivot axle apertures and the outer pivot axle apertures, while the bearing axle is mounted in the bearing axle apertures of the inner arm. One or more bearing axle springs are secured to the outer arm and are in biasing contact with the bearing axle. The lift lobe contacting bearing is mounted to the bearing axle between the first and second inner side arm.

In another embodiment, a rocker arm for engaging a cam having a lift lobe and at least one safety lobe comprises a cam contacting member for transferring motion from the cam to the rocker arm, and at least one biasing spring. An outer arm of the rocker arm has at least one safety lobe contacting surface configured to be capable of contacting one or more safety lobes only during abnormal rocker arm operation. The inner arm is disposed between the first and second side arms of the outer arm, and has a first and second inner side arm. The cam contacting member is disposed between the first and second inner side arms.

In yet another embodiment, a deactivating rocker arm for engaging a cam having a lift lobe and a first and second safety lobe is provided. The rocker arm comprises a first end and a second end, an outer arm, an inner arm, a pivot axle, a lift lobe contacting member for transferring motion from the cam to the rocker arm, a latch for selectively deactivating the rocker arm, and at least one biasing spring. The outer arm has a first and second outer side arm. The first and second outer side arms have safety lobe contacting surfaces configured to be in contact with the first and second safety lobes only during abnormal rocker arm operation. Axle slots in the outer side arms are configured to accept the lift lobe contacting member and are also configured to permit lost motion movement of the inner arm relative to the outer arm.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
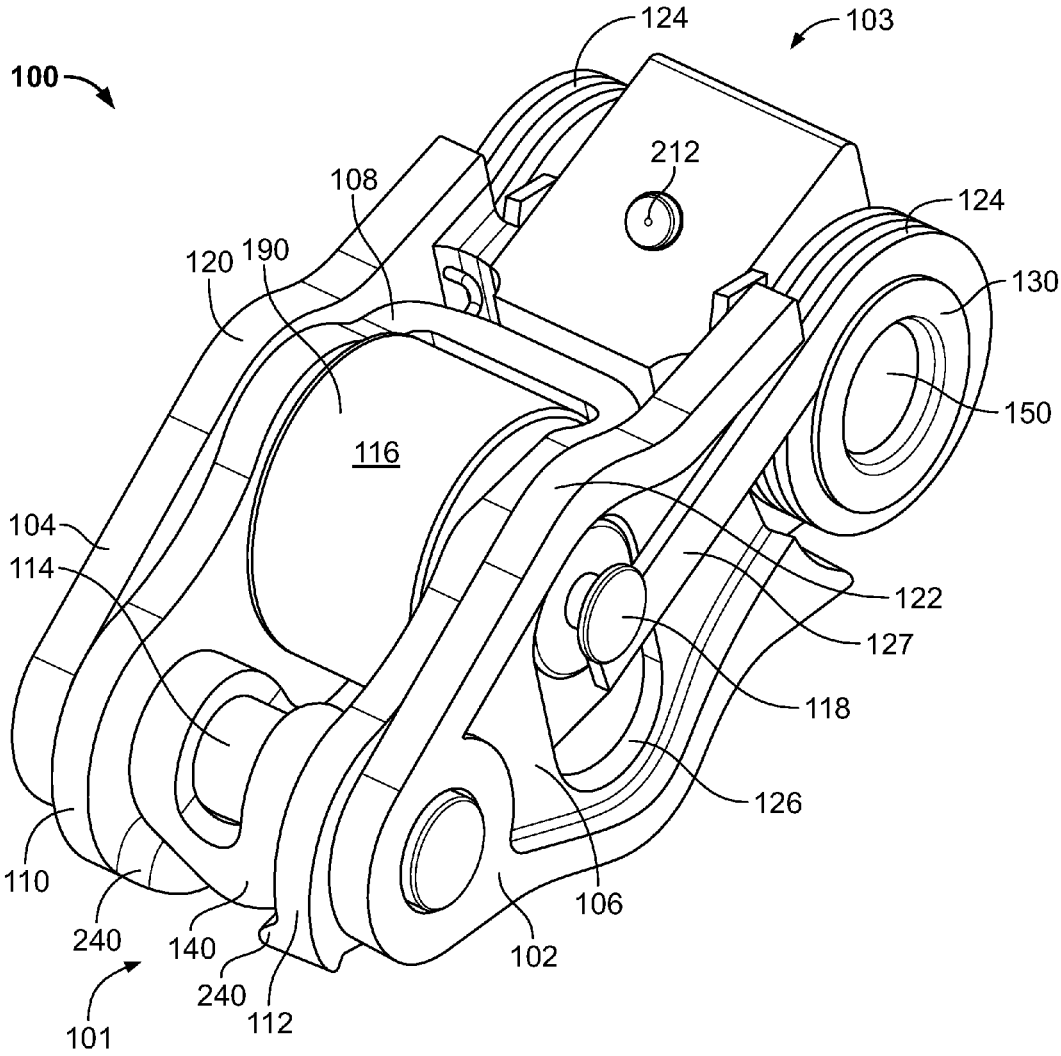
FIG. 1 illustrates a perspective view of an exemplary rocker arm 100 incorporating first and second safety lobe contacting surfaces 120, 122.

Certain terminology will be used in the following description for convenience in describing the figures will not be limiting. The terms "upward," "downward," and other directional terms used herein will be understood to have their normal meanings and will refer to those directions as the drawing figures are normally viewed.

FIG. 1 illustrates a perspective view of an exemplary deactivating rocker arm 100. The deactivating rocker arm 100 is shown by way of example only and it will be appreciated that the configuration of the deactivating rocker arm 100 that is the subject of this application is not limited to the configuration of the deactivating rocker arm 100 illustrated in the figures contained herein.

Figure 2:
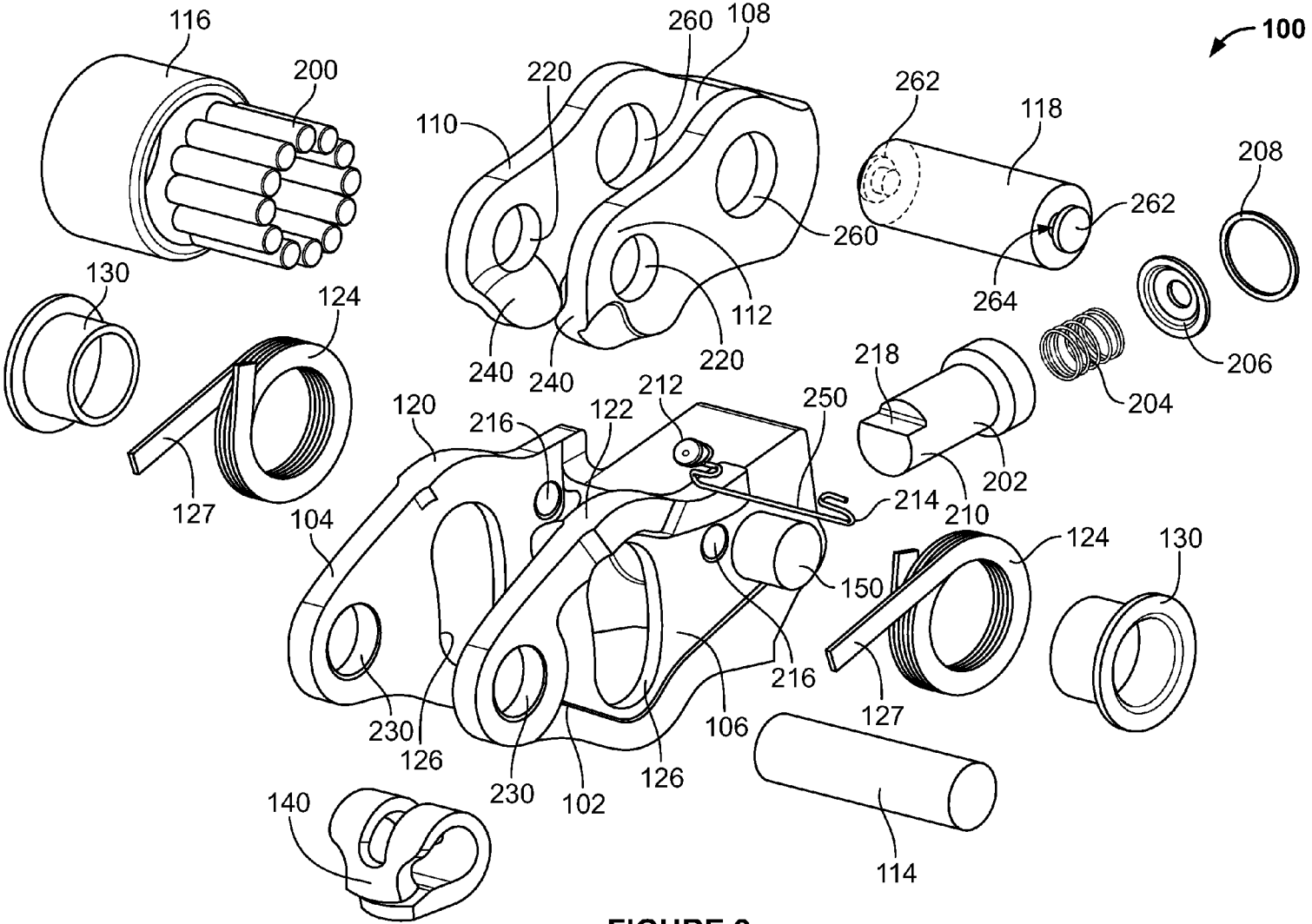
FIG. 2 illustrates an exploded view of the exemplary rocker arm 100 incorporating first and second safety lobe contacting surfaces 120, 122 shown in FIG. 1.

As shown in FIGS. 1 and 2, the deactivating rocker arm 100 includes an outer arm 102 having a first outer side arm 104 and a second outer side arm 106. An inner arm 108 is disposed between the first outer side arm 104 and second outer side arm 106. The inner arm 108 has a first inner side arm 110 and a second inner side arm 112. The inner arm 108 and outer arm 102 are both mounted to a pivot axle 114, located adjacent the first end 101 of the rocker arm 100, which secures the inner arm 108 to the outer arm 102 while also allowing a rotational degree of freedom pivoting about the pivot axle 114 when the deactivating rocker arm 100 is in a deactivated state. In addition to the illustrated embodiment having a separate pivot axle 114 mounted to the outer arm 102 and inner arm 108, the pivot axle 114 may be integral to the outer arm 102 or the inner arm 108.

The rocker arm 100 has a bearing 190 comprising a roller 116 that is mounted between the first inner side arm 110 and second inner side arm 112 on a bearing axle 118 that, during normal operation of the rocker arm, serves to transfer energy from a rotating cam (not shown) to the rocker arm 100. Mounting the roller 116 on the bearing axle 118 allows the bearing 190 to rotate about the axle 118, which serves to reduce the friction generated by the contact of the rotating cam with the roller 116. As discussed herein, the roller 116 is rotatably secured to the inner arm 108, which in turn may rotate relative to the outer arm 102 about the pivot axle 114 under certain conditions. In the illustrated embodiment, the bearing axle 118 is mounted to the inner arm 108 in the bearing axle apertures 260 of the inner arm 108 and extends through the bearing axle slots 126 of the outer arm 102. Other configurations are possible when utilizing a bearing axle 118, such as having the bearing axle 118 not extend through bearing axle slots 126 but still mounted in bearing axle apertures 260 of the inner arm 108, for example.

When the rocker arm 100 is in a deactivated state, the inner arm 108 pivots downwardly relative to the outer arm 102 when the lifting portion of the cam (324 in FIG. 3) comes into contact with the roller 116 of bearing 190, thereby pressing it downward. The axle slots 126 allow for the downward movement of the bearing axle 118, and therefore of the inner arm 108 and bearing 190. As the cam continues to rotate, the lifting portion of the cam rotates away from the roller 116 of bearing 190, allowing the bearing 190 to move upwardly as the bearing axle 118 is biased upwardly by the bearing axle springs 124. The illustrated bearing axle springs 124 are torsion springs secured to mounts 150 located on the outer arm 102 by spring retainers 130. The bearing axle springs 124 are secured adjacent the second end 103 of the rocker arm 100 and have spring arms 127 that come into contact with the bearing axle 118. As the bearing axle 118 and spring arm 127 move downward, the bearing axle 118 slides along the spring arm 127. The configuration of rocker arm 100 having the axle springs 124 secured adjacent the second end 103 of the rocker arm 100, and the pivot axle 114 located adjacent the first end 101 of the rocker arm, with the bearing axle 118 between the pivot axle 114 and the axle spring 124, lessens the mass near the first end 101 of the rocker arm.

Figure 3:
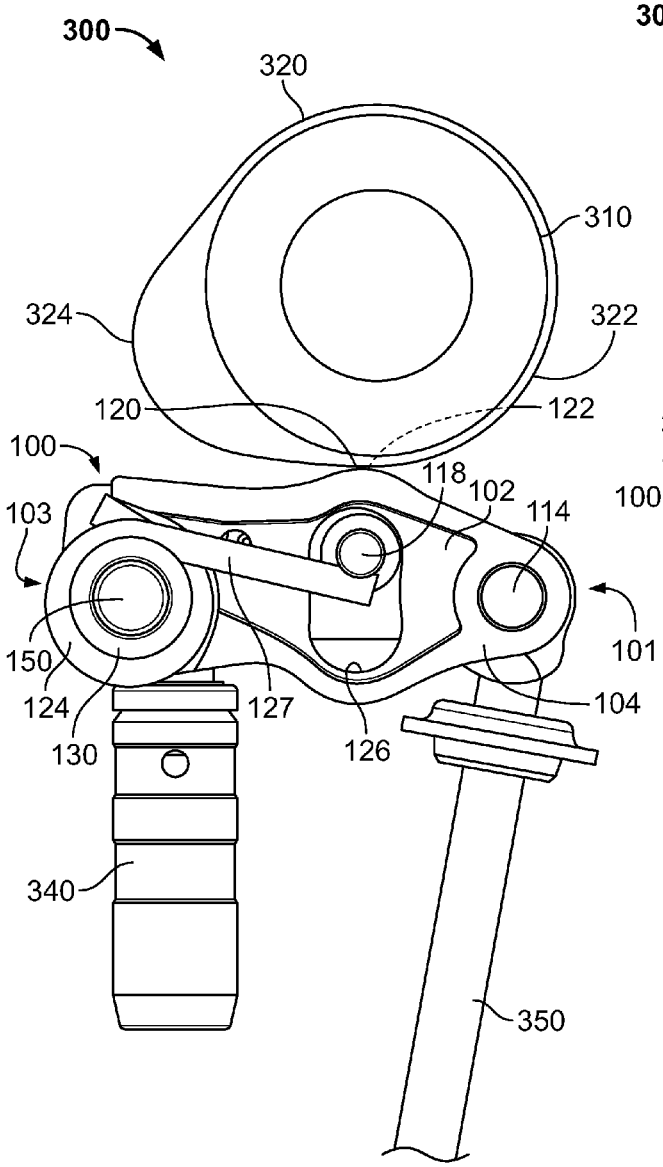
FIG. 3 illustrates a side view of the deactivating rocker arm 100 in relation to a cam 300, lash adjuster 340 and valve stem 350.
Figure 4:
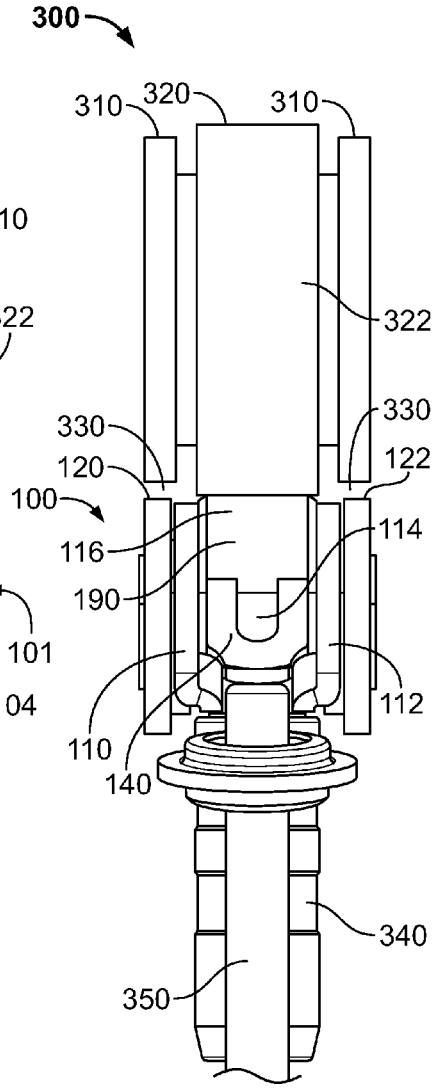
FIG. 4 illustrates a front view of the deactivating rocker arm 100 in relation to a cam 300, lash adjuster 340 and valve stem 350.

As shown in FIGS. 3 and 4, the valve stem 350 is also in contact with the rocker arm 100 near its first end 101, and thus the reduced mass at the first end 101 of the rocker arm 100 reduces the mass of the overall valve train (not shown), thereby reducing the force necessary to change the velocity of the valve train. It should be noted that other spring configurations may be used to bias the bearing axle 118, such as a single continuous spring.

With continued reference to FIG. 1, the first outer side arm 104 and second outer side arm 106 have a first safety lobe contacting surface 120 and second safety lobe contacting surface 122, respectively, positioned at the top of the outer arm 102. As shown in more detail in FIGS. 3 and 4, during normal operation, the surfaces 120, 122 are spaced from the safety lobes 310 of the cam. The surfaces 120, 122 are configured to come into contact with the safety lobes 310 only when the rocker arm 100 is functioning abnormally, such as a failure of the rocker arm 100. In certain abnormal conditions, examples of which are described more fully below, the surfaces 120, 122 come into contact with the safety lobes 310, thereby preventing the rocker arm 100 from moving upwardly by an undesirable amount. By limiting the contact between the safety lobe contacting surfaces 120, 122 and the safety lobes to instances where the rocker arm 100 is operating abnormally, rather than having frequent or constant contact, the need for placement of friction pads or preparing the safety lobe contacting surfaces 120, 122 with a durable wear surface is eliminated, thereby achieving cost efficiencies.

FIG. 2 illustrates a exploded view of the deactivating rocker arm 100 of FIG. 1. As shown in FIG. 2, when assembled, the bearing 190 shown in FIG. 1 is a needle roller-type bearing that comprises a substantially cylindrical roller 116 in combination with needles 200, which can be mounted on a bearing axle 118. The bearing 190 serves to transfer the rotational motion of the cam to the rocker arm 100 that in turn transfers motion to the valve stem 350, for example in the configuration shown in FIGS. 3 and 4. As shown in FIGS. 1 and 2, the bearing axle 118 may be mounted in the bearing axle apertures 260 of the inner arm 108. In such a configuration, the axle slots 126 of the outer arm 102 accept the bearing axle 118 and allow for lost motion movement of the bearing axle 118 and by extension the inner arm 108 when the rocker arm 100 is in a deactivated state. "Lost motion" movement can be considered movement of the rocker arm 100 that does not transmit the rotating motion of the cam to the valve. In the illustrated embodiments, lost motion is exhibited by the pivotal motion of the inner arm 108 relative to the outer arm 102 about the pivot axle 114. Knob 262 extends from the end of the bearing axle 118 and creates a slot 264 in which the spring arm 127 sits. In one alternative, a hollow bearing axle 118 may be used along with a separate spring mounting pin (not shown) comprising a feature such as the knob 262 and slot 264 for mounting the spring arm 127 in a manner similar to that shown in FIG. 2.

Other configurations other than bearing 190 also permit the transfer of motion from the cam to the rocker arm 100. For example, a smooth non-rotating surface (not shown) for interfacing with the cam lift lobe (320 in FIG. 3) may be mounted on or formed integral to the inner arm 108 at approximately the location where the bearing 190 is shown in FIG. 1 relative to the inner arm 108 and rocker arm 100. Such a non-rotating surface may comprise a friction pad formed on the non-rotating surface. In another example, alternative bearings, such as bearings with multiple concentric rollers, may be used effectively as a substitute for bearing 190.

The mechanism for selectively deactivating the rocker arm 100, which in the illustrated embodiment is found near the second end 103 of the rocker arm 100, is shown in FIG. 2 as comprising latch 202, latch spring 204, spring retainer 206 and clip 208. The latch 202 is configured to be mounted inside the outer arm 102. The latch spring 204 is placed inside the latch 202 and secured in place by the latch spring retainer 206 and clip 208. Once installed, the latch spring 204 biases the latch 202 toward the first end 101 of the rocker arm 100, allowing the latch 202, and in particular the engaging portion 210 to engage the inner arm 108, thereby preventing the inner arm 108 from moving with respect to the outer arm 102. When the latch 202 is engaged with the inner arm in this way, the rocker arm 100 is in the activated state, and will transfer motion from the cam to the valve stem.

In the assembled rocker arm 100, the latch 202 alternates between activating and deactivating positions. To deactivate the rocker arm 100, oil pressure sufficient to counteract the biasing force of latch spring 204 may be applied, for example, through the port 212 which is configured to permit oil pressure to be applied to the surface of the latch 202. When the oil pressure is applied, the latch 202 is pushed toward the second end 103 of the rocker arm 100, thereby withdrawing the latch 202 from engagement with the inner arm 108 and allowing the inner arm 108 to rotate about the pivot axle 114. In both the activated and deactivated states, the linear portion 250 of orientation clip 214 engages the latch 202 at the flat surface 218. The orientation clip is mounted in the clip apertures 216, and thereby maintains a horizontal orientation of the linear portion 250 relative to the rocker arm 100. This restricts the orientation of the flat surface 218 to also be horizontal, thereby orienting the latch 202 in the appropriate direction for consistent engagement with the inner arm 108.

With reference to FIGS. 1 and 2, the elephant foot 140 is mounted on the pivot axle 114 between the first 110 and second 112 inner side arms. The pivot axle 114 is mounted in the inner pivot axle apertures 220 and outer pivot axle apertures 230 adjacent the first end 101 of the rocker arm 100. Lips 240 formed on inner arm 108 prevent the elephant foot 140 from rotating about the pivot axle 114. The elephant foot 140 engages the end of the valve stem 350 as shown in FIG. 4. In an alternative embodiment, the elephant foot 140 may be removed, and instead an interfacing surface complementary to the tip of the valve stem 350 may be placed on the pivot axle 114.

FIGS. 3 and 4 illustrate a side view and front view, respectively, of rocker arm 100 in relation to a cam 300 having a lift lobe 320 with a base circle 322 and lifting portion 324, and two circular safety lobes 310 positioned above the first and second safety lobe contacting surfaces 120, 122. The circular safety lobes 310 are concentric with the base circle 322 of the lift lobe 320, and have a smaller diameter than the diameter of the base circle 322. It should be noted that the diameter of the two safety lobes 310 need not be identical, need not be circular, and may have a diameter equal to or larger than the diameter of the base circle 322. In such a scenario, the first and second safety lobe contacting surfaces 120, 122 should be appropriately located such that they are spaced from the safety lobes 310 under normal engine operation, but also come into contact with the safety lobes 310 under abnormal engine conditions, for example under the abnormal conditions as described herein. As is clear from FIGS. 3 and 4, first and second safety lobe contacting surfaces 120, 122, when used in combination with the circular safety lobes 310, do not transfer rotational motion of the cam to the rocker arm. In other embodiments, a rocker arm 100 having one or three or more safety lobe contacting surfaces may be used, for example, with cams having one safety lobe, or three or more safety lobes (not shown).

FIGS. 3 and 4 illustrate the roller 116 in contact with the lift lobe 320. A lash adjuster 340 engages the rocker arm 100 adjacent its second end 103, and applies upward pressure to the rocker arm 100, and in particular the outer rocker arm 102, while mitigating against valve lash. The valve stem 350 engages the elephant foot 140 adjacent the first end 101 of the rocker arm 100. In the activated state, the rocker arm 100 periodically pushes the valve stem 350 downward, which serves to open the corresponding valve (not shown).

During normal operation, which may occur when the rocker arm 100 is in an activated or deactivated state, a gap 330 separates the safety lobes 310 from the first and second safety lobe contacting surfaces 120, 122. However, during certain abnormal operation, the safety lobes 310 may come into contact with the first and second safety lobe contacting surfaces 120, 122. In one such scenario, a deactivated rocker arm 100 is subjected to excessive pump-up of the lash adjuster 340, whether due to excessive oil pressure, the onset of non-steady-state conditions, for example as a result of dynamic mis-motion that may be caused by high revolutions per second, or other causes. This results in an increase in the effective length of the lash adjuster 340 as pressurized oil fills its interior. Such a scenario may occur for example during a cold start of the engine, and could take significant time to resolve on its own if left unchecked and could even result in permanent engine damage. Under such circumstances, the latch 202 may not be able to activate the rocker arm 100 until the lash adjuster 340 has returned to a normal operating length. In this scenario, the lash adjuster 340 applies upward pressure to the outer arm 102, bringing the outer arm 102 closer to the cam 300. As the outer arm 102 continues upward, the safety lobe contacting surfaces 120, 122 come into contact with the safety lobes 310, preventing further upward movement of the outer arm 102, which, if unimpeded, could result in a portion of the rocker arm 100 near the rocker arm second end 103 undesirably contacting the cam 300. This illustrated embodiment allows for relatively quicker return to normal operating conditions for the rocker arm 100, and in addition may allow for the rocker arm 100 to return to an activated state more quickly, thus avoiding an excessively long recovery time waiting for the rocker arm 100 to return to an activated state.

Still other scenarios may result in the safety lobe contacting surfaces 120, 122 coming into contact with the safety lobes 310. For example, a failure of the roller 116 or the bearing axle 118, or a failure of the lift lobe 320 may result in the safety lobe contacting surfaces 120, 122 coming into contact with the safety lobes 310. It should be noted that not all abnormal operating circumstances for the rocker arm will result in the safety lobes 310 coming into contact with the first and second safety lobe contacting surfaces 120, 122.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A rocker arm for engaging a cam having at least one lift lobe and at least one substantially circular safety lobe, the at least one lift lobe having a lift lobe base circle, the lift lobe base circle having a lift lobe base circle diameter, the at least one safety lobe positioned concentrically with the base circle and having a diameter less than the diameter of the base circle, the rocker arm comprising:

an outer arm, an inner arm, a pivot axle, a lift lobe contacting bearing, a bearing axle, and at least one bearing axle spring;

the outer arm having a first and a second outer side arms, the first and the second outer side arms having at least one safety lobe contacting surface configured to be spaced from the at least one safety lobe during normal engine operation, and outer pivot axle apertures configured for mounting the pivot axle;

the inner arm disposed between the first and second outer side arms, and having a first and a second inner side arms, the first and second inner side arms having inner pivot axle apertures configured for mounting the pivot axle, and inner bearing axle apertures configured for mounting the bearing axle;

the pivot axle disposed in the inner pivot axle apertures and the outer pivot axle apertures;

the bearing axle mounted in the bearing axle apertures of the inner arm; and, the at least one bearing axle spring secured to the outer arm and in biasing contact with the bearing axle, the lift lobe contacting bearing mounted to the bearing axle between the first and the second inner side arms.

2. The apparatus of claim 1 wherein the rocker arm comprises:

a latch for selectively securing the inner arm relative to the outer arm thereby selectively permitting lost motion movement of the inner arm relative to the outer arm about the pivot axle.

3. The apparatus of claim 1 wherein the rocker arm further comprises:

a first end and a second end, the pivot axle mounted adjacent the first end, the at least one bearing axle spring secured to the outer arm adjacent the second end, and the bearing axle mounted between the pivot axle and the at least one bearing axle spring.

4. The apparatus of claim 1 wherein the rocker arm further comprises:

a means for selectively deactivating the rocker arm.

5. The apparatus of claim 1 wherein the rocker arm further comprises:

a latch configured to be capable of selectively deactivating the rocker arm.

6. The apparatus of claim 1 wherein the at least one bearing axle spring is a torsion spring secured to the outer arm and the at least one bearing axle spring comprises a spring arm in biasing contact with the bearing axle.

7. The apparatus of claim 1 wherein the at least one bearing axle spring comprises:

a first and a second bearing axle springs, the first bearing axle spring secured to the first outer side arm and the second bearing axle spring secured to the second outer side arm, the first and second bearing axle springs in biasing contact with the bearing axle.

8. The apparatus of claim 1 wherein an elephant foot configured to be capable of engaging a valve stem is mounted to the pivot axle between the first and second inner side arm.

9. A rocker arm for engaging a cam having a lift lobe and at least one safety lobe, comprising:

an outer arm, an inner arm, a cam contacting member configured to be capable of transferring motion from the cam to the rocker arm, and at least one biasing spring;

the outer arm having a first and a second outer side arms, the first and the second outer side arms having at least one safety lobe contacting surface configured to be capable of contacting the at least one safety lobe only during abnormal rocker arm operation;

the inner arm disposed between the first and the second outer side arms, and having a first and a second inner side arms;

the inner arm secured to the outer arm by a pivot axle configured to permit rotating movement of the inner arm relative to the outer arm about the pivot axle;

the cam contacting member disposed between the first and second inner side arm;

the at least one biasing spring secured to the outer arm, the at least one biasing spring in biasing contact with the cam contacting member.

10. The apparatus of claim 9 wherein the rocker arm further comprises a latch for selectively securing the inner arm relative to the outer arm thereby selectively permitting lost motion movement of the inner arm relative to the outer arm about the pivot axle.

11. The apparatus of claim 9 wherein the rocker arm further comprises a first end and a second end, the pivot axle disposed adjacent the first end, the biasing spring secured to the outer arm adjacent the second end, and the cam contacting member disposed between the pivot axle and the biasing spring.

12. The apparatus of claim 9 wherein the rocker arm further comprises a latch configured to be capable of selectively deactivating the rocker arm.

13. The apparatus of claim 9 wherein the at least one biasing spring comprises:

at least one torsion spring secured to the outer arm having a spring arm in biasing contact with the cam contacting member.

14. The apparatus of claim 9 wherein the at least one biasing spring comprises a first and a second biasing springs, the first biasing spring secured to the first outer side arm and the second biasing spring secured to the second outer side arm, the first and second biasing springs in biasing contact with the cam contacting member.

15. The apparatus of claim 9 wherein an elephant foot configured to be capable of receiving a valve stem is mounted to the pivot axle between the first and the second inner side arms.

16. The apparatus of claim 9 wherein cam contacting member comprises a bearing mounted on a bearing axle.

17. A deactivating rocker arm for engaging a cam having a lift lobe and a first and second safety lobe, comprising:

a first end and a second end, an outer arm, an inner arm, a pivot axle, a lift lobe contacting member configured to be capable of transferring motion from the cam lift lobe to the rocker arm, a latch configured to be capable of selectively deactivating the rocker arm, and at least one biasing spring;

the outer arm having a first and a second outer side arms, the first and the second outer side arms having safety lobe contacting surfaces configured to be in contact with the first and second safety lobes only during abnormal rocker arm operation, outer pivot axle apertures configured for mounting the pivot axle, and axle slots configured to accept the lift lobe contacting member and configured to permit lost motion movement of the lift lobe contacting member;

the inner arm disposed between the first and second outer side arms, and having a first and a second inner side arms, the first and second inner side arms having inner pivot axle apertures configured for mounting the pivot axle, and inner lift lobe contacting member apertures configured for mounting the lift lobe contacting member;

the pivot axle mounted adjacent the first end of the rocker arm and disposed in the inner pivot axle apertures and the outer pivot axle apertures;

the latch disposed adjacent the second end of the rocker arm;

the lift lobe contacting member mounted in the lift lobe contacting member apertures of the inner arm and the axle slots of the outer arm and between the pivot axle and latch; and, at least one biasing spring secured to the outer arm and in biasing contact with the lift lobe contacting member.

18. The deactivating rocker arm of claim 17, wherein the at least one biasing spring is secured to the outer arm adjacent the second end of the rocker arm.

19. The deactivating rocker arm of claim 17 wherein the lift lobe contacting member comprises a bearing mounted on a bearing axle.

* * * * *